US008550683B2

(12) United States Patent
Ho et al.

(10) Patent No.: US 8,550,683 B2
(45) Date of Patent: Oct. 8, 2013

(54) CONVERGING ILLUMINANT DEVICE

(75) Inventors: Yao-Min Ho, Taichung (TW); Jih-Tao Hsu, Taichung (TW)

(73) Assignee: Automotive Research & Testing Center, Lugang Chen, Changhua Hsien (TW)

( * ) Notice: Subject to any disclaimer, the term of this patent is extended or adjusted under 35 U.S.C. 154(b) by 187 days.

(21) Appl. No.: 13/288,733

(22) Filed: Nov. 3, 2011

(65) Prior Publication Data

US 2013/0114267 A1 May 9, 2013

(51) Int. Cl.
*F21V 7/04* (2006.01)

(52) U.S. Cl.
USPC ..... 362/607; 362/97.3; 362/609; 362/619; 362/627; 362/629

(58) Field of Classification Search
USPC ..... 362/607, 609, 619, 627, 97.3, 629
See application file for complete search history.

(56) References Cited

U.S. PATENT DOCUMENTS 6,633,351 B2 * 10/2003 Hira et al. ..... 349/95
7,484,874 B2 * 2/2009 Lee et al. ..... 362/607
7,665,877 B2 * 2/2010 Lee et al. ..... 362/608
8,177,408 B1 * 5/2012 Coleman ..... 362/615
8,220,978 B2 * 7/2012 Shiau et al. ..... 362/607
8,408,775 B1 * 4/2013 Coleman ..... 362/615
2007/0002452 A1 * 1/2007 Munro ..... 359/627
2008/0055929 A1 * 3/2008 Kuroda et al. ..... 362/609
2011/0058389 A1 * 3/2011 Shiau et al. ..... 362/607

* cited by examiner

*Primary Examiner* — Stephen F Husar
*Assistant Examiner* — James Cranson, Jr.
(74) *Attorney, Agent, or Firm* — patenttm.us

(57) ABSTRACT

A converging illuminant device has a flat illuminant, a reflective layer and an enhancement film. The reflective layer abuts the flat illuminant, is grille-shaped and has multiple longitudinal strips and multiple lateral strips. The enhancement film is securely connected with the reflective layer and has an emissive surface. The emissive surface has multiple free-form curved areas, multiple longitudinal lines and multiple lateral lines. The longitudinal lines respectively align with the longitudinal strips. The lateral lines respectively align with the lateral strips. Because the reflective layer is grille-shaped, light definitely passes through central positions of the free-form curved areas, angles of refraction of the light are small and the light can be effectively converged. Consequently, illuminant efficiency and central luminous intensity are increased.

17 Claims, 8 Drawing Sheets

CONVERGING ILLUMINANT DEVICE

BACKGROUND OF THE INVENTION

1. Field of the Invention

The present invention relates to a converging illuminant device, and more particularly to a converging illuminant device having an excellent light converging effect.

2. Description of Related Art

A conventional flat illuminant comprises multiple OLEDs (Organic Light Emitting Diode) and shows a Lambertian pattern of light. However, angles of reflection of light emitted by the flat illuminant are large and the light emitted by the flat illuminant disperses. Consequently, illuminant efficiency and central luminous intensity are low.

When the conventional flat illuminant is applied to a rear lamp, large number of OLEDs are necessary to be arranged to a specific pattern and to achieve a statutory luminous intensity in compliance with laws, such as regulations about rear lamps mounted on a back of a car.

An enhancement film is often attached to a top surface of the flat illuminant to condense and shape light. Nevertheless, a light converging effect provided by the enhancement film is still insufficient and needs improvement.

To overcome the shortcomings, the present invention tends to provide a converging illuminant device to mitigate the aforementioned problems.

SUMMARY OF THE INVENTION

The main objective of the invention is to provide a converging illuminant device having an excellent light converging effect.

A converging illuminant device has a flat illuminant, a reflective layer and an enhancement film. The reflective layer abuts the flat illuminant, is grille-shaped and has multiple longitudinal strips and multiple lateral strips. The enhancement film is securely connected with the reflective layer and has an emissive surface. The emissive surface has multiple free-form curved areas, multiple longitudinal lines and multiple lateral lines. The longitudinal lines respectively align with the longitudinal strips. The lateral lines respectively align with the lateral strips. Because the reflective layer is grille-shaped, light definitely passes through central positions of the free-form curved areas, angles of refraction of the light are small and the light can be effectively converged. Consequently, illuminant efficiency and central luminous intensity are increased.

Other objects, advantages and novel features of the invention will become more apparent from the following detailed description when taken in conjunction with the accompanying drawings.

DETAILED DESCRIPTION OF PREFERRED EMBODIMENT

Figure 1:
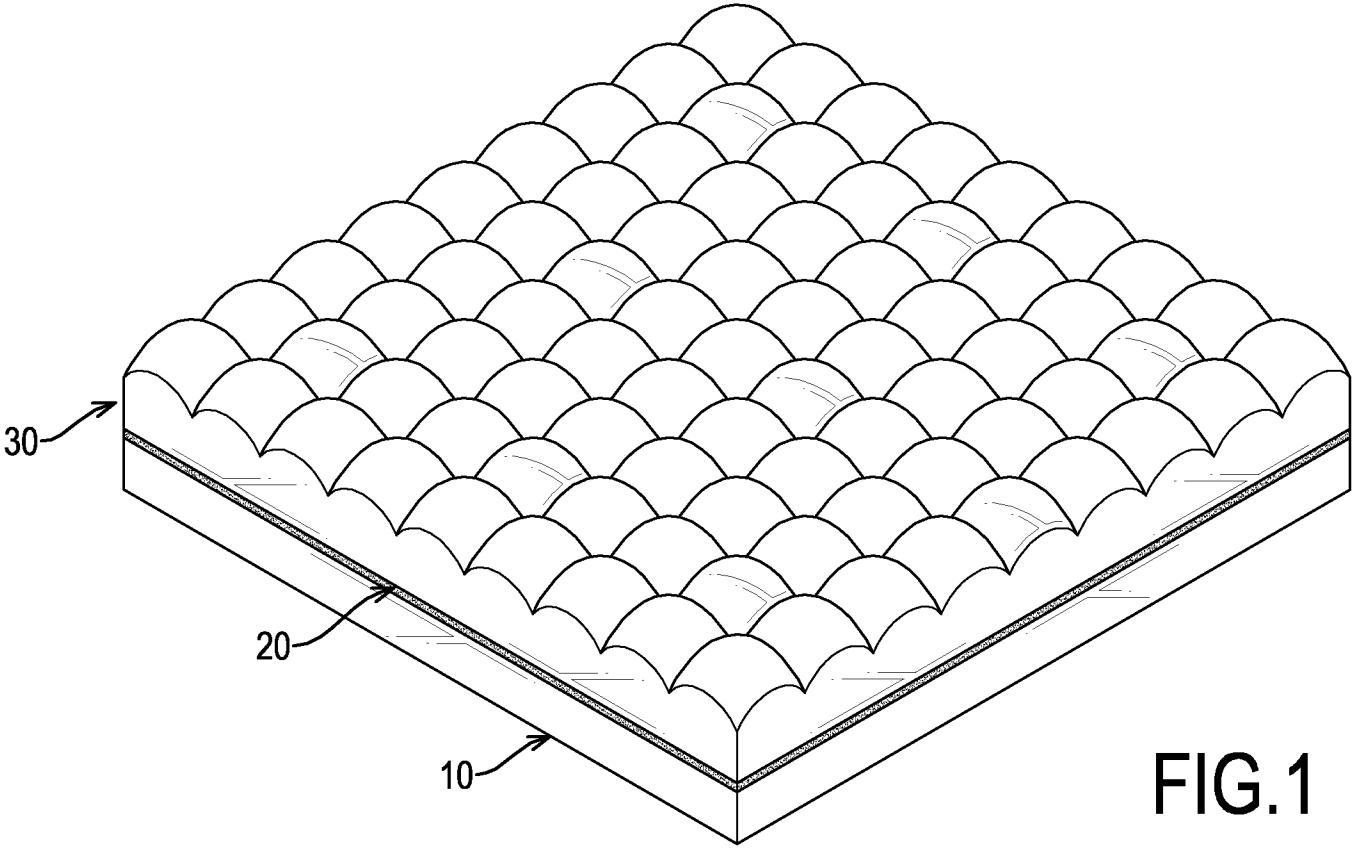
FIG. 1 is a perspective view of a converging illuminant device in accordance with the present invention.
Figure 2:
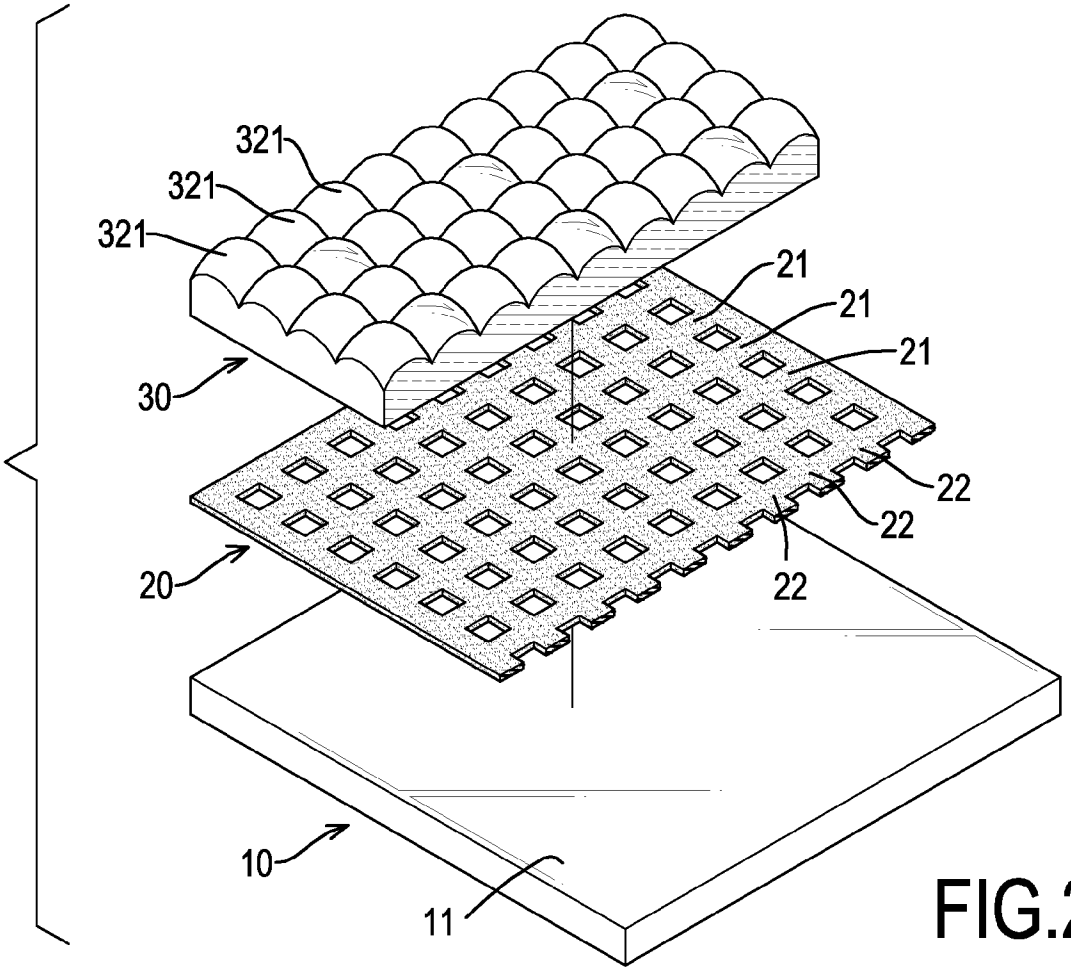
FIG. 2 is an exploded perspective view of the converging illuminant device in FIG. 1.
Figure 3:
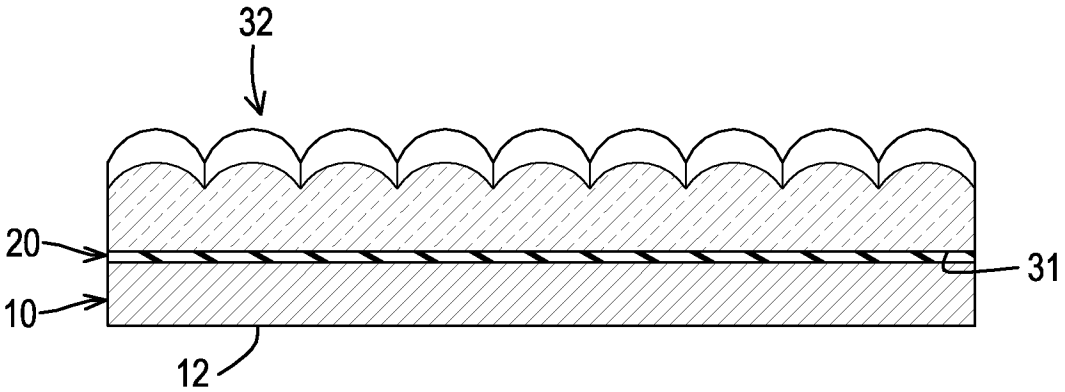
FIG. 3 is a cross sectional view of the converging illuminant device in FIG. 1.

With reference to FIGS. 1 to 3, a converging illuminant device in accordance with the present invention in turn comprises a flat illuminant 10, a reflective layer 20 and an enhancement film 30.

The flat illuminant 10 is a flexible sheet and has an illuminant surface 11 and a reflective surface 12 opposite to the illuminant surface 11. Preferably, the illuminant 10 comprises multiple OLEDs (Organic Light Emitting Diodes).

The reflective layer 20 abuts the illuminant surface 11, is grille-shaped and has multiple longitudinal strips 21 and multiple lateral strips 22. The longitudinal strips 21 are parallel to each other. The lateral strips 22 are parallel to each other.

Preferably, each longitudinal strip 21 is perpendicular to each lateral strip 22. A width of each longitudinal strip 21 is the same as that of each lateral strip 22.

Figure 4:
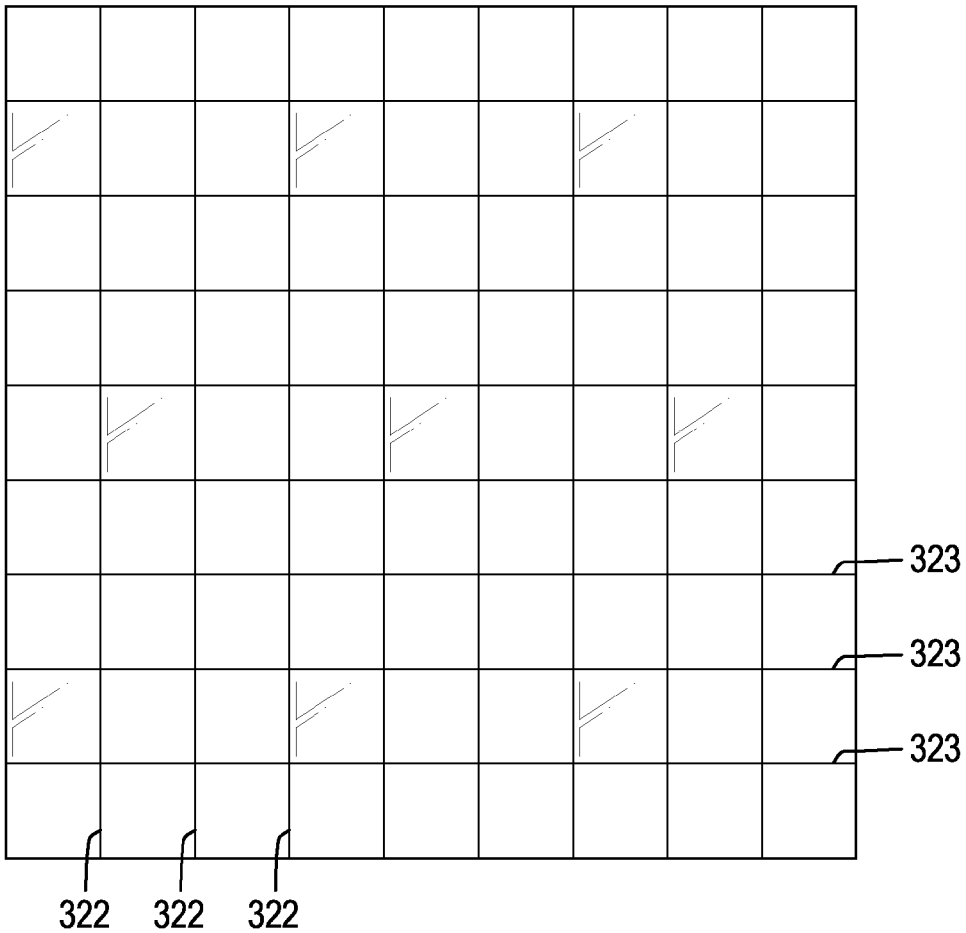
FIG. 4 is a top view of the enhancement film of the converging illuminant device in FIG. 1.

With reference to FIGS. 2 to 4, the enhancement film 30 is pervious to light, is securely connected with the reflective layer 20 and has a connecting surface 31 and an emissive surface 32. Preferably, the enhancement film 30 is made of transparent resin and is flexible.

The connecting surface 31 is flat and is securely connected with the reflective layer 20. Preferably, the reflective layer 20 is connected with the connecting surface 31 with plating process.

The emissive surface 32 is opposite to the connecting surface 31 and has multiple free-form curved areas 321, multiple longitudinal lines 322 and multiple lateral lines 323.

The convex free-form curved areas 321 are arranged as a matrix.

The longitudinal lines 322 are formed on the emissive surface 32 beside the convex free-form curved areas 321, are parallel to each other and respectively align with the longitudinal strips 21.

The lateral lines 323 are formed on the emissive surface 32 beside the convex free-form curved areas 321 and the longitudinal lines 322, are parallel to each other and respectively align with the lateral strips 22.

Figure 5:
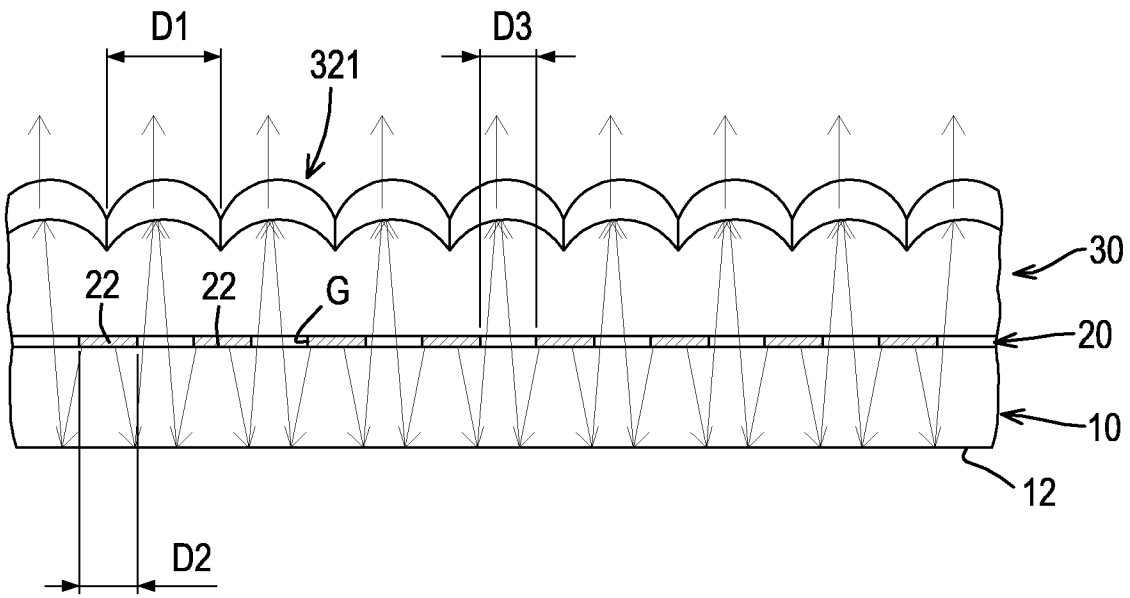
FIG. 5 is an operational side view of the converging illuminant device in FIG. 1 showing light routes.

FIG. 5 refers to an operational view of the converging illuminant device showing light routes. A width of each free-form curved area 321 is defined as a width D1. A width of each lateral strip 22 is defined as a width D2. The reflective layer 20 has multiple gaps G. Each gap G is formed between two adjacent lateral strips 22 and a width of each gap G is defined as a width D3. Preferably, the width D3 of each gap G is half of the width D1 of each free-form curved area 321. Accordingly, each gap G is located at a central position of one of the free-form curved areas 321.

Some of the light emitted from the flat illuminant 10 is reflected by the lateral strips 22, returns to the reflective surface 12 and is reflected by the reflective surface 12 until the light travels through the gaps G and through the enhancement film 30.

With the grille-shaped reflective layer 20, light definitely passes through the central positions of the free-form curved areas 321. Accordingly, angles of refraction of the light are not large and the light can be converged.

As long as the reflective layer 20 is grille-shaped and aligns with the enhancement film 30, the light converging effect provided by the reflective layer 20 is achieved. The present invention does not limit the widths of the longitudinal strips 21 and the lateral strips 22.

With the enhancement film 30 and the reflective layer 20, the light emitted by the flat illuminant 10 can be adjusted and shaped to a specific pattern to conform to laws and regulations about rear lamps.

Figure 6:
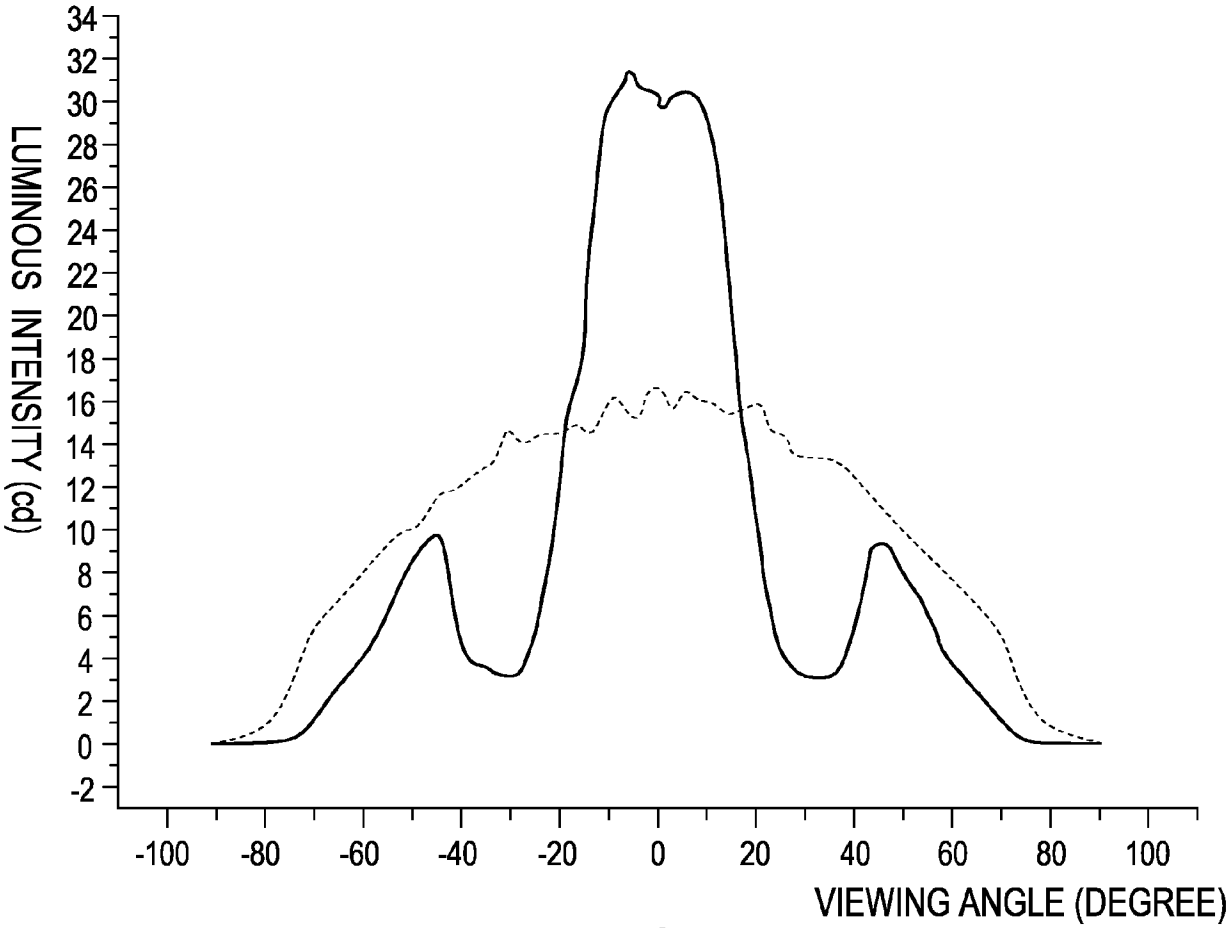
FIG. 6 is a diagram showing the viewing angle-luminous intensity graph of the converging illuminant device in accordance with the present invention.

With further reference to FIG. 6, the abscissa in the graph refers to a viewing angle and a unit of the abscissa is degrees. The ordinate in the graph refers to a luminous intensity and a unit of the ordinate is cd (candela). A dotted line in the graph refers to a distribution of luminous intensity of a conventional flat illuminant. The maximal luminous intensity of the dotted line is approximately 17 cd.

A solid line in the graph refers to a distribution of luminous intensity of the converging illuminant device in accordance with the present invention. The maximal luminous intensity of the solid line is approximately 33.02 cd, about twice as high as that of the dotted line.

Figure 7:
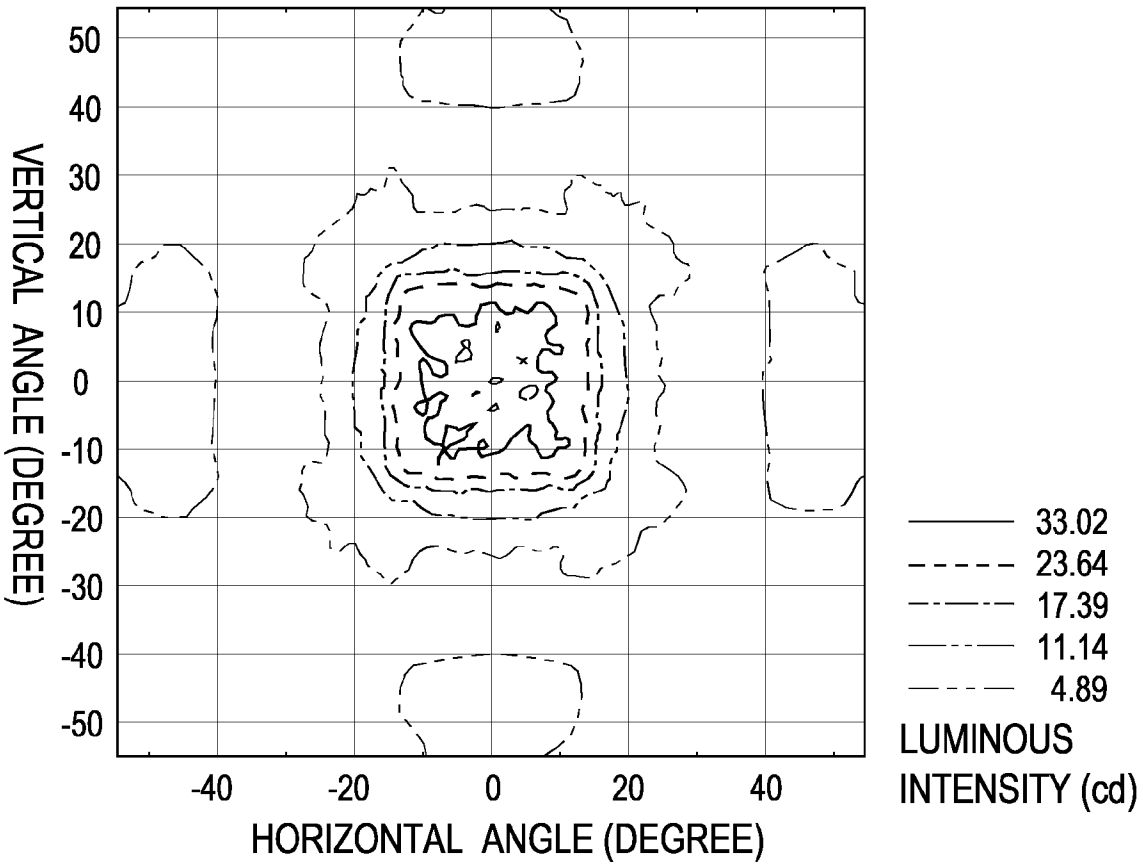
FIG. 7 is a diagram showing the luminous intensity distribution pattern of the converging illuminant device in accordance with the present invention.
Figure 8:
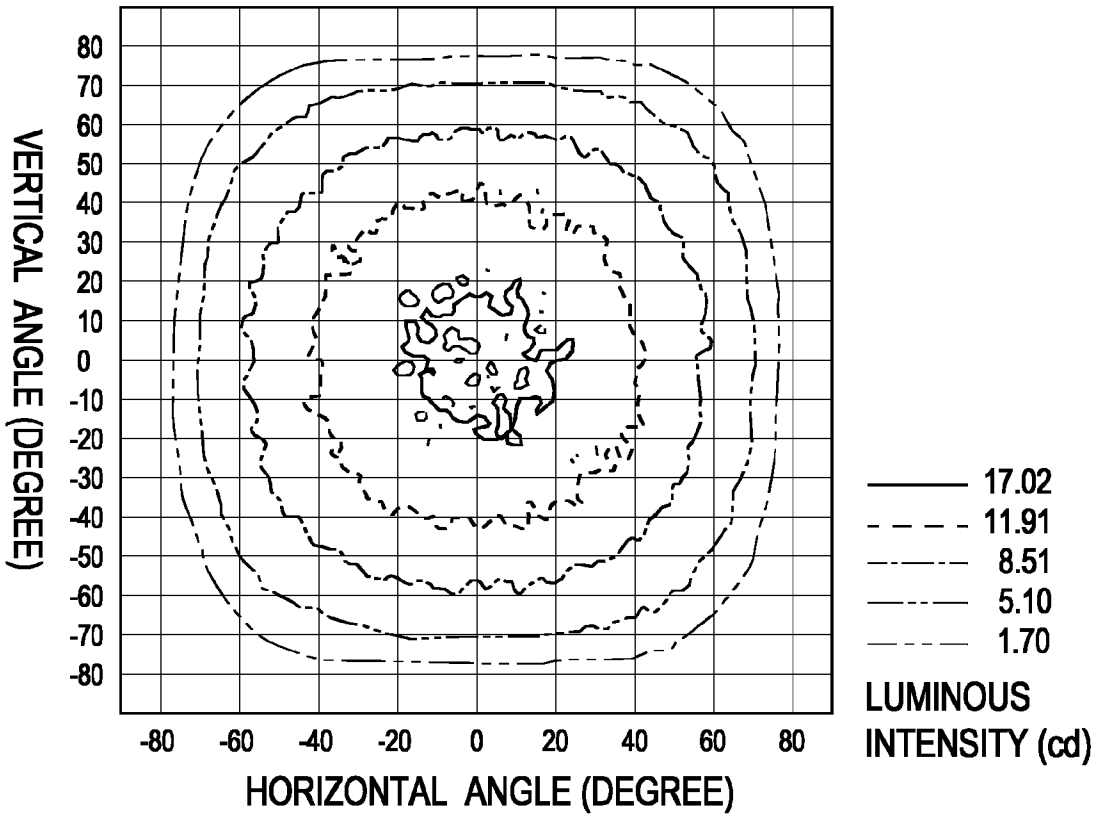
FIG.8 PRIOR ART
FIG. 8 is a diagram showing the luminous intensity distribution pattern of a conventional flat illuminant in accordance with the prior art.

With reference to FIGS. 7 and 8, the abscissa in the graphs refers to a horizontal angle and a unit of the abscissa is degrees. The ordinate in the graphs refers to a vertical angle and a unit of the ordinate is degrees.

FIG. 7 shows a luminous intensity distribution pattern of the converging illuminant device in accordance with the present invention. FIG. 8 shows a luminous intensity distribution pattern of the conventional flat illuminant. Obviously, the pattern of FIG. 7 is more focused than that of FIG. 8.

The converging illuminant device is not only applied to a rear lamp, but is also applied to a desk lamp or a sidelight. The present invention is not limited to specific fields.

From the above description, it is noted that the present invention has the following advantages:

1. Excellent light converging effect:

Because the reflective layer 20 is grille-shaped, light definitely passes through the central positions of the free-form curved areas 321, angles of refraction of the light are small and the light can be effectively converged. Consequently, illuminant efficiency and central luminous intensity are increased. Amount of OLEDs in the flat illuminant 10 is reduced. Accordingly, a manufacturing cost and measure of area of the flat illuminant 10 can also be reduced.

2. Easy assembling:

The converging illuminant device in accordance with the present invention does not change the structure of the flat illuminant 10, but makes the enhancement film 30 plated with the reflective layer 20 in advance. Then the enhancement film 30 plated with the reflective layer 20 is placed onto the flat illuminant 10. The plating of the enhancement film 30 is easily processed and the enhancement film 30 is easily attached to the flat illuminant 10. Because the reflective layer 20 does not have to align with the flat illuminant 10, the assembling of the converging illuminant device is easy and convenient.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A converging illuminant device comprising:

a flat illuminant having an illuminant surface;

a reflective layer abutting the illuminant surface, being grille-shaped and having multiple longitudinal strips parallel to each other; and multiple lateral strips parallel to each other; and an enhancement film pervious to light, securely connected with the reflective layer and having a flat connecting surface securely connected with the reflective layer; and an emissive surface opposite to the connecting surface and having multiple convex free-form curved areas arranged as a matrix;

multiple longitudinal lines formed on the emissive surface beside the convex free-form curved areas, parallel to each other and respectively aligning with the longitudinal strips; and multiple lateral lines formed on the emissive surface beside the convex free-form curved areas and the longitudinal lines, parallel to each other and respectively aligning with the lateral strips.

2. The converging illuminant device as claimed in claim 1, wherein each longitudinal strip is perpendicular to each lateral strip.

3. The converging illuminant device as claimed in claim 2, wherein a width of each length is the same as that of each lateral strip.

4. The converging illuminant device as claimed in claim 2, wherein the reflective layer has multiple gaps; each gap is formed between two adjacent lateral strips; and a width of each gap is half of a width of each free-form curved area.

5. The converging illuminant device as claimed in claim 3, wherein the reflective layer has multiple gaps; each gap is formed between two adjacent lateral strips; and a width of each gap is half of a width of each free-form curved area.

6. The converging illuminant device as claimed in claim 1, wherein the reflective layer is connected with the connecting surface with plating process.

7. The converging illuminant device as claimed in claim 2, wherein the reflective layer is connected with the connecting surface with plating process.

8. The converging illuminant device as claimed in claim 4, wherein the reflective layer is connected with the connecting surface with plating process.

9. The converging illuminant device as claimed in claim 5, wherein the reflective layer is connected with the connecting surface with plating process.

10. The converging illuminant device as claimed in claim 1, wherein the enhancement film is made of transparent resin.

11. The converging illuminant device as claimed in claim 2, wherein the enhancement film is made of transparent resin.

12. The converging illuminant device as claimed in claim 8, wherein the enhancement film is made of transparent resin.

13. The converging illuminant device as claimed in claim 9, wherein the enhancement film is made of transparent resin.

14. The converging illuminant device as claimed in claim 1, wherein the enhancement film is flexible.

15. The converging illuminant device as claimed in claim 2, wherein the enhancement film is flexible.

16. The converging illuminant device as claimed in claim 8, wherein the enhancement film is flexible.

17. The converging illuminant device as claimed in claim 9, wherein the enhancement film is flexible.

* * * * *